US009050733B2

(12) United States Patent
Zhu

(10) Patent No.: US 9,050,733 B2
(45) Date of Patent: Jun. 9, 2015

(54) FOOD PRODUCT SLICER WITH REMOVABLE KNIFE COVER PLATE AND ASSOCIATED METHOD

(71) Applicant: Guangshan Zhu, Richmond Hill, GA (US)

(72) Inventor: Guangshan Zhu, Richmond Hill, GA (US)

(73) Assignee: PREMARK FEG L.L.C., Glenview, IL (US)

( * ) Notice: Subject to any disclaimer, the term of this patent is extended or adjusted under 35 U.S.C. 154(b) by 295 days.

(21) Appl. No.: 13/756,987

(22) Filed: Feb. 1, 2013

(65) Prior Publication Data

US 2013/0298741 A1 Nov. 14, 2013

Related U.S. Application Data

(60) Provisional application No. 61/644,156, filed on May 8, 2012.

(51) Int. Cl.

| | |
|---|---|
| ***B26D 7/00*** | (2006.01) |
| ***B26D 7/22*** | (2006.01) |
| *B26D 7/06* | (2006.01) |

(52) U.S. Cl.

CPC ..... *B26D 7/225* (2013.01); *Y10T 29/49817* (2015.01); *Y10T 29/49826* (2015.01); *B26D 2007/0012* (2013.01); *B26D 7/00* (2013.01); *B26D 7/0616* (2013.01); *B26D 2210/02* (2013.01)

(58) Field of Classification Search

CPC ..... B26D 2210/02; B26D 2007/0012; B26D 7/00; B26D 7/0616; B26D 7/225; B26D 1/143

USPC ..... 83/478, 13

See application file for complete search history.

(56) References Cited

U.S. PATENT DOCUMENTS

| | | | | |
|---|---|---|---|---|
| 2,563,120 | A * | 8/1951 | Klingens et al. | 83/94 |
| 2,698,638 | A * | 1/1955 | Foster | 83/166 |
| 4,186,634 | A * | 2/1980 | Akczinski, Sr. | 83/478 |
| 4,246,818 | A * | 1/1981 | McGraw, Jr. | 83/478 |
| 4,520,703 | A * | 6/1985 | Speckhart | 83/478 |
| 5,188,011 | A * | 2/1993 | Somal et al. | 83/478 |
| 5,509,337 | A | 4/1996 | Norman et al. | |
| 5,591,072 | A * | 1/1997 | Tweed et al. | 451/293 |
| 5,782,001 | A * | 7/1998 | Gray | 30/391 |
| 5,860,343 | A * | 1/1999 | Koch et al. | 83/168 |
| 2007/0137447 | A1* | 6/2007 | Chen et al. | 83/13 |
| 2008/0243125 | A1* | 10/2008 | Guzman et al. | 606/82 |
| 2008/0271584 | A1* | 11/2008 | Repaci | 83/471 |

(Continued)

FOREIGN PATENT DOCUMENTS

| | | |
|---|---|---|
| DE | 4418351 | 12/1995 |
| DE | 10311404 A1 | 9/2004 |

OTHER PUBLICATIONS

PCT International Search Report; mailed Jun. 6/26, 2013, PCT/US2013/039413; filed Mar. 5, 2013.

PCT Written Opinion; mailed Jun. 6/20, 2013; PCT/US2013/039413; filed Mar. 5, 2013.

(Continued)

*Primary Examiner* — Sean Michalski

(74) *Attorney, Agent, or Firm* — Thompson Hine LLP

(57) ABSTRACT

A food product slicer includes a slicer body, a rotatable slicer knife and a removable knife cover plate. The knife cover plate is releasably secured in place on the slicer at least in part by a magnetic field. One or more slots or openings on the knife cover plate may also be provided.

20 Claims, 8 Drawing Sheets

(56) References Cited

U.S. PATENT DOCUMENTS

2012/0118122 A1* 5/2012 Sasaki ..... 83/478
2014/0260848 A1* 9/2014 Gantke et al. ..... 83/24

OTHER PUBLICATIONS

PCT International Search Report on Patentability; [PCT/US2013/039413; filed May 3, 2013]; date of issuance Nov. 11, 2014, 8 pages.

* cited by examiner

FOOD PRODUCT SLICER WITH REMOVABLE KNIFE COVER PLATE AND ASSOCIATED METHOD

CROSS-REFERENCES

This application claims the benefit of Provisional Application 61/644,156 filed May 8, 2012.

TECHNICAL FIELD

This application relates generally to food product slicers used for slicing bulk food products and, more specifically, to a food product slicer including a removable knife cover plate.

BACKGROUND

A typical food product slicer includes a rotating slicer knife and a carriage that holds food product. The carriage moves back and forth past the rotating knife to cut slices. The cover plate is positioned over the slicer knife such that food product on the carriage slides across the face of the cover plate as the carriage moves past the knife in the cutting stroke and as the carriage moves in a reverse stroke. Typical prior art cover plates are mounted to the slicer using either a threaded knob, spring-loaded plunger or a knob with cam features. To install/uninstall the top cover, a slicer operator rotates the knob or pulls the plunger to lock/unlock the top cover from the slicer. There is at least one moving part associated with the top cover for the install/uninstall functions.

It would be desirable to provide a food product slicer with a cover plate configuration that facilitates simple installation, removal and cleaning of the cover plate.

SUMMARY

In one aspect, a slicer for use in slicing a food product includes a slicer body and a circular slicer knife mounted for rotation relative to the slicer body, the slicer knife having a peripheral cutting edge. A carriage is mounted for moving food product back and forth past the circular slicer knife. A knife cover plate is removably mounted to the slicer and covers a face portion and edge portion of the slicer knife, the knife cover plate held in place on the slicer at least in part by a magnet mounted on the slicer.

In one embodiment, the magnet is located radially outward of the peripheral cutting edge of the slicer knife.

In one implementation of the foregoing embodiment, a ring guard is disposed about the peripheral cutting edge along at least a portion of a non-cutting zone of the circular slice knife, and the magnet mounted on a portion of the ring guard. The portion of the ring guard may be an extension part that is located toward an upper portion of the ring guard.

A position of the magnet relative to the ring guard may be adjustable. In one implementation of such an embodiment, the position of the magnet is adjustable along an axis the enables movement of the magnet toward or away from the cover plate.

In one embodiment, the knife cover plate includes a knob mounted thereon, the knob secured by a fastener having a head portion that aligns with the magnet to interact with a magnetic field of the magnet.

The cover plate may further include at least two slots or openings mounted on at least two pins of the slicer.

In another aspect, a slicer for use in slicing a food product includes a slicer body, a circular slicer knife mounted for rotation relative to the slicer body, the slicer knife having a peripheral cutting edge and a carriage mounted for moving food product back and forth past the slicer knife. A knife cover plate is removably mounted to the slicer and covers a face portion and edge portion of the slicer knife. The knife cover plate is held in place on the slicer at least in part by a magnetic field that operates to pull the knife cover plate toward the slicer, but which magnetic field can be overcome for removal of the knife cover plate by manually pulling the knife cover plate away from the slicer.

In one implementation of the slicer of the preceding paragraph, the knife cover plate includes a graspable knob thereon in a vicinity of the magnetic field, pulling the knob pulls the knife cover plate away from the slicer by pivoting the knife cover plate.

In one implementation of the slicer of the preceding paragraph, the knob is located on an upper portion of the knife cover plate, a lower portion of the knife cover plate includes at least one slot engaged with a pin on the slicer, and pulling the knob pulls the knife cover plate away from the slicer by pivoting the upper portion of the knife cover plate away from the slicer while the slot in the lower portion of the knife cover plate remains engaged with the pin.

In one implementation of the slicer of the preceding paragraph, the lower portion of the knife cover plate includes first and second spaced apart slots engaged with first and second pins of the slicer respectively.

In one implementation of the slicer of one of the four preceding paragraphs, a strength of interaction of the magnetic field with the knife cover plate can be adjusted. Where the magnetic field is produced by a magnet mounted on the slicer, the strength of interaction can be adjusted by varying a position of the magnet on the slicer to adjust a distance between the magnet and the knife cover plate.

Where the knife cover plate is formed primarily of a non-magnetic material, a magnetic material part is located thereon for interacting with the magnetic field.

In another aspect, a method is provided for utilizing a knife cover plate in conjunction with a slicer having a slicer body, a circular slicer knife mounted for rotation relative to the slicer body, the slicer knife having a peripheral cutting edge and a carriage mounted for moving food product back and forth past the slicer knife. The method involves: locating a magnet on one of a portion of the knife cover plate or a mount portion of the slicer; locating a part formed of magnetic material on the other of the portion of the knife cover plate or the mount portion of the slicer; mounting the knife cover plate onto the slicer by positioning the knife cover plate such that a magnetic field of the magnet interacts with the part to pull the knife cover plate toward the mount portion of the slicer to aid in retaining the knife cover plate on the slicer.

The method of the preceding paragraph may further involve removing the knife cover plate from the slicer by pulling the portion of the knife cover plate away from the mount portion of the slicer.

In one implementation, the knife cover plate pivots as the portion of the knife cover plate is pulled away from the mount portion of the slicer.

In one implementation, to facilitate the pivot, a knob is located on or proximate to the portion of the knife cover plate, another portion of the knife cover plate includes at least one slot engaged with a pin on the slicer, and during pivoting of the knife cover plate the slot remains engaged with the pin.

The details of one or more embodiments are set forth in the accompanying drawings and the description below. Other features, objects, and advantages will be apparent from the description and drawings, and from the claims.

DETAILED DESCRIPTION

Figure 1:
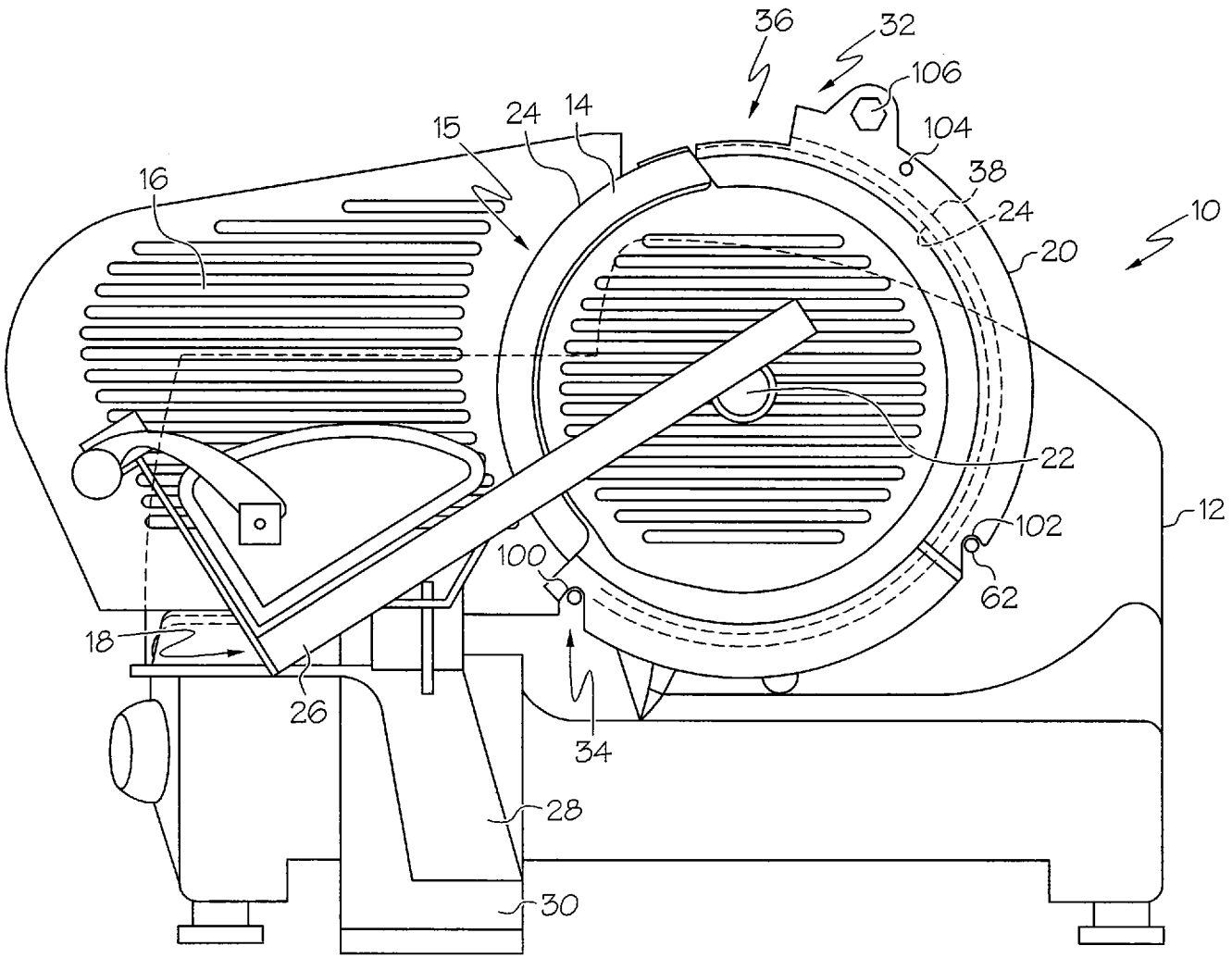
FIG. 1 is a side elevation of a food product slicer.

Referring to FIG. 1, a food slicing machine 10 includes housing 12 (often times also referred to as a base), circular slicing knife 14, gauge plate 16, product supporting carriage 18, and a knife cover plate 20. The housing may be consider part of the slicer body, which may include other portions such as castings. The circular slicing knife 14 is mounted to the housing for rotation about an axis 22 by a motor or other drive (not shown). A peripheral cutting edge 24 of the knife is exposed in a cutting region 15 of the knife that is proximate the gauge plate 16 (e.g., generally extending from approximately a seven o'clock position to an eleven o'clock position in the illustrated embodiment, with other variations possible). The gauge plate 16 is movable transversely with respect to a plane defined by the peripheral edge 24 of the knife to control slice thickness, and can be located in a "zero" position wherein it is slightly raised above the cutting zone of the peripheral edge 24. The food product carriage 18 includes tray 26 mounted on support arm 28, which in turn may be pivotally mounted to a transport 30 that extends into the housing. The transport 30 is supported internal of the housing for linear, reciprocating movement back and forth past the slicer knife 14 in any suitable manner, variations of which are known in the art. Carriage movement may be implemented manually or automatically (e.g., as by a drive motor and belt system, hydraulics or other means). As food product is moved past the cutting edge 24 of the knife 14 in a slicing stroke (i.e., left to right in the view of FIG. 1), the food product on the tray 26 slides across the outwardly facing surface of the cover plate 20, which surface may be formed with raised ridges to improve slidability.

The illustrated cover plate 20 covers the peripheral cutting edge 24 of the slicer knife 14 from about a one o'clock position 32 to about a seven o'clock position 34. The peripheral cutting edge 24 is shown in dashed line form beneath the cover plate 20. In a twelve o'clock region 36 of the slicer knife 14, the cover plate diameter decreases to provide a space or opening at which the edge of knife can be sharpened. The cover plate 20 also extends over a ring guard 38 (only inner edge shown in dashed line form in FIG. 1) that is disposed about the peripheral cutting edge along at least a portion of the non-cutting zone of the circular slice knife, leaving a gap between ring guard and the peripheral cutting edge as shown. The ring guard may be fixed to the housing 12 in a stationary manner, or may be fixed to the housing to permit some movement for cleaning as described in U.S. Pat. No. 5,509,337. A ring guard cover (not shown) may also be provided in accordance with U.S. Pat. No. 7,487,702. In order to facilitate knife replacement, the knife cover plate 20 is removable as described below.

Figure 2A:
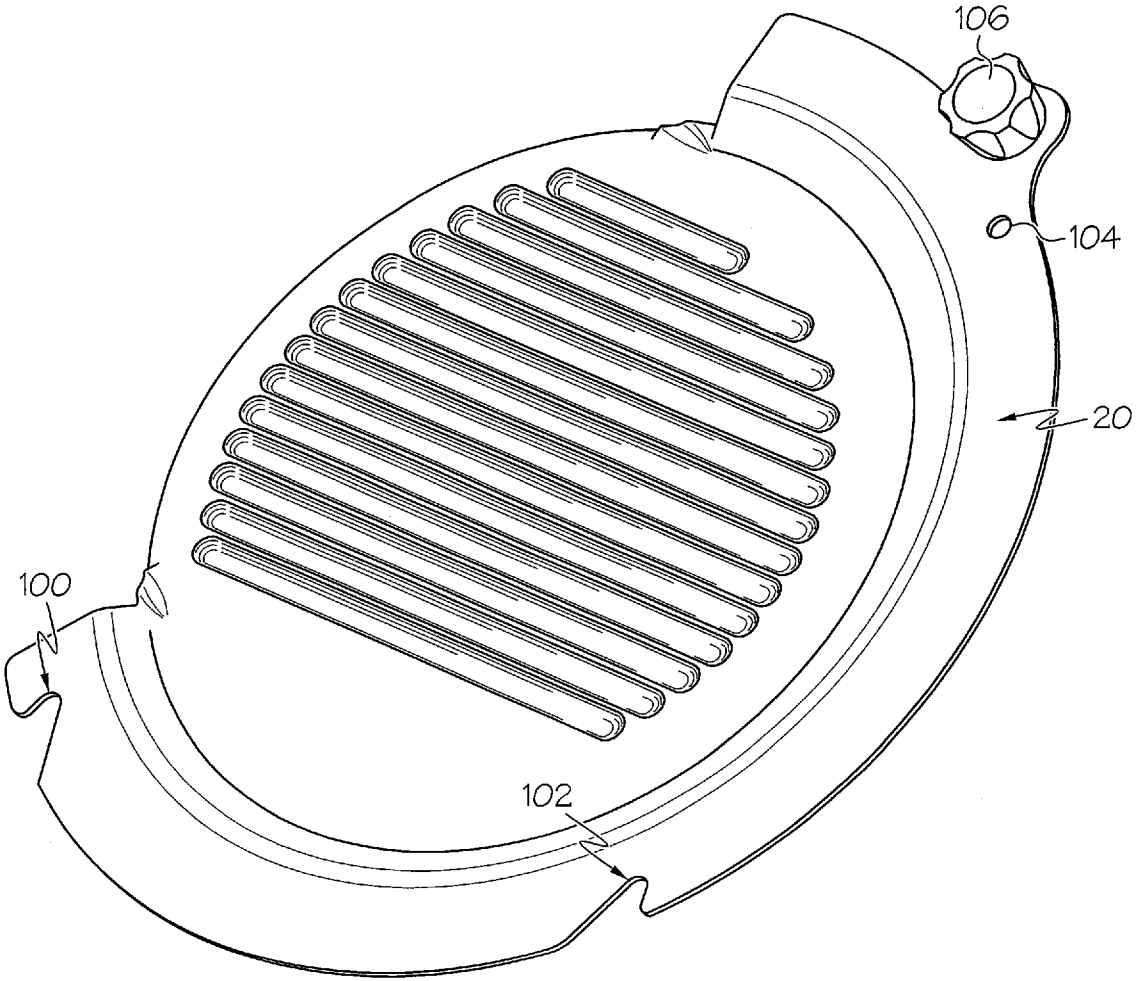
FIGS. 2A and 2B are front and rear perspective views of one embodiment of the knife cover plate of the slicer of FIG. 1.
Figure 2B:
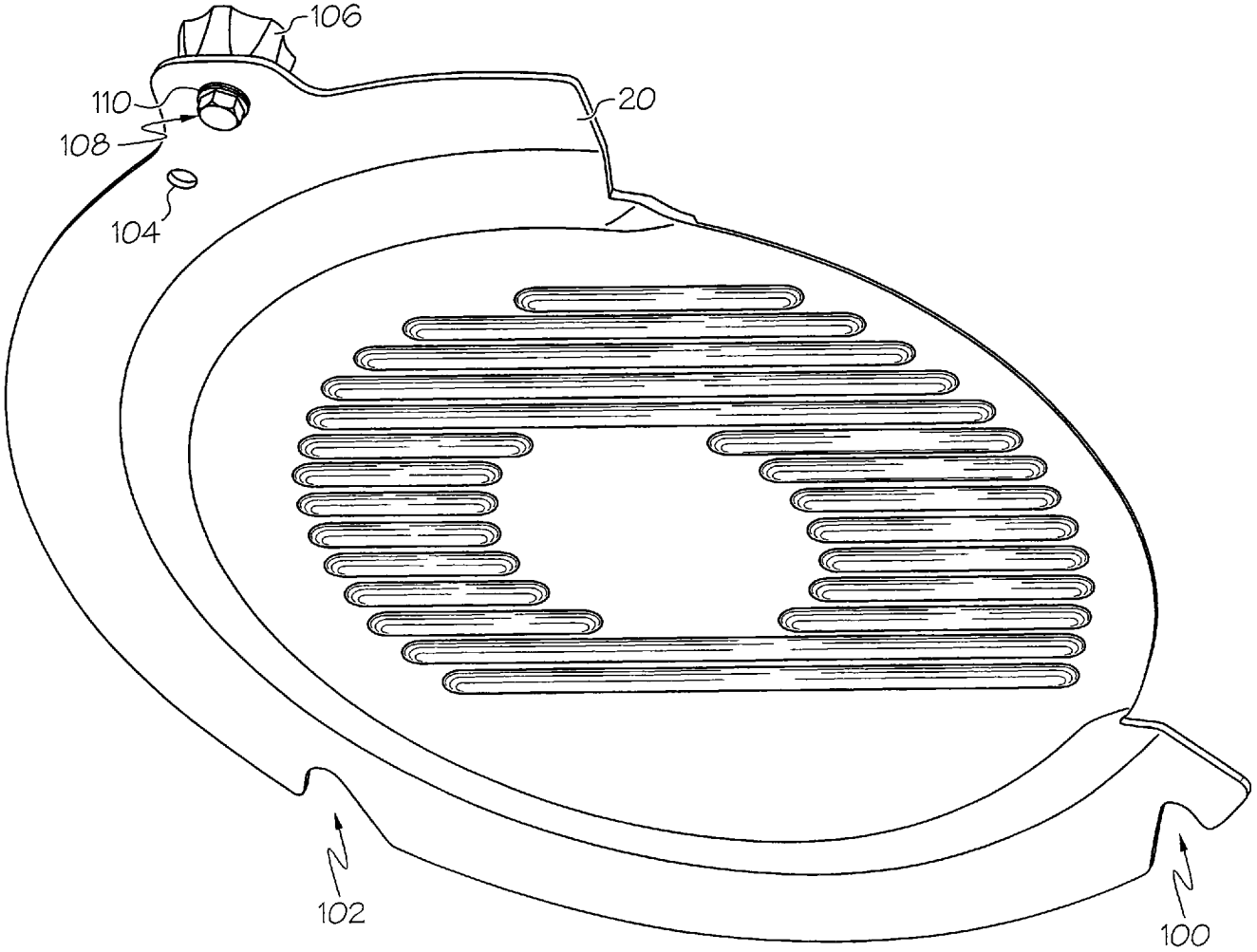

Referring to FIGS. 2A and 2B, the cover plate 20 includes lower peripheral slots 100 and 102 at roughly the 7:00 and 4:00 positions (relative to the view of FIG. 1 with respect to axis 22), but those positions could vary. An upper pin hole 104 is also provided along with a fixed knob 106 to facilitate handling of the cover plate. The knob 106, which may be plastic, stainless or other material, is secured to the cover plate by a screw or bolt 108 (of a magnetic material such as a stainless steel with magnetic properties) having a head portion at the rear side of the cover plate per FIG. 2B. A sealing washer 110 may be provided between the rear side of the cover plate and the screw/bolt head.

Figure 3:
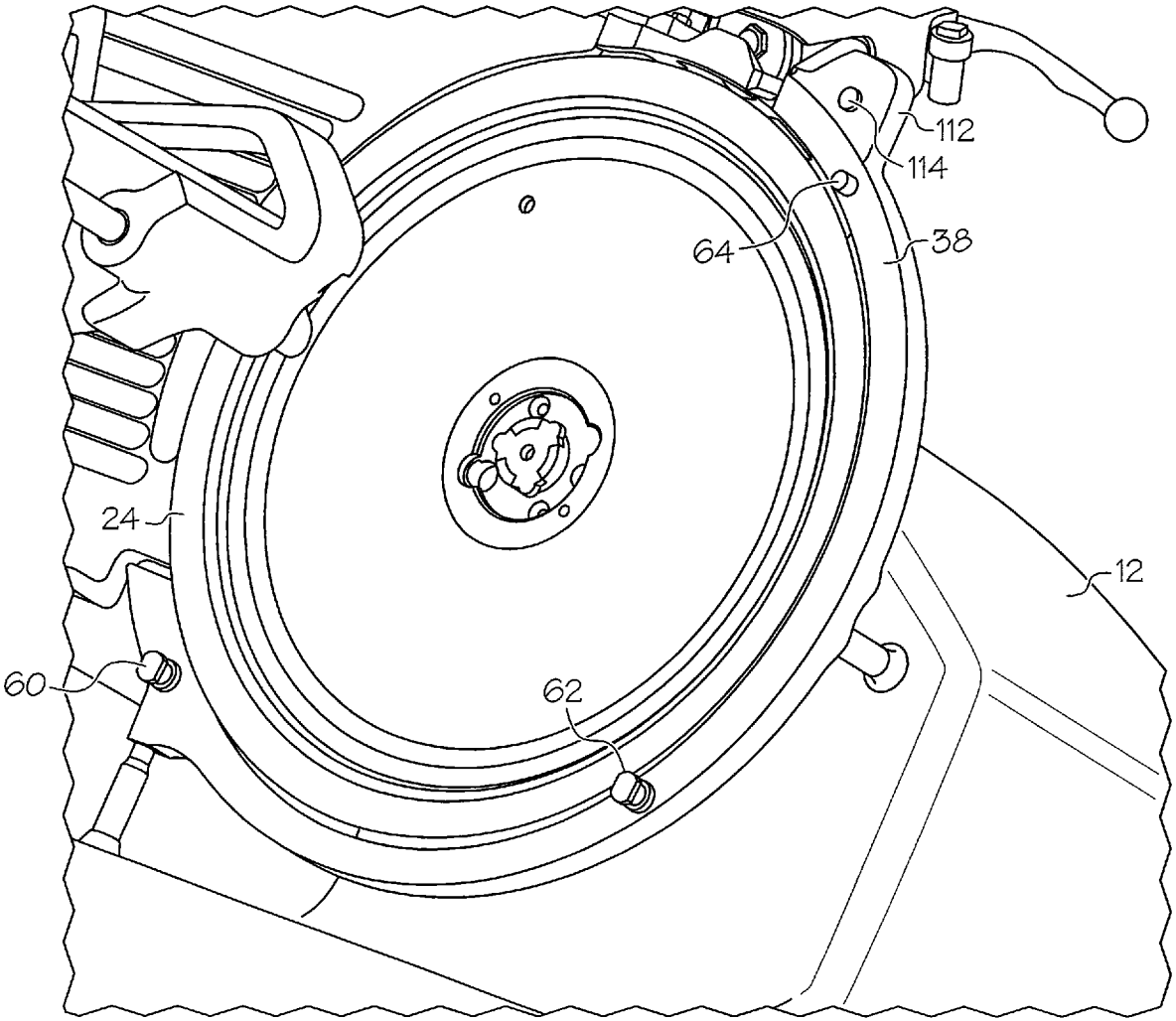
FIG. 3 is a partial perspective view of a slicer with knife cover plate removed.
Figure 4:
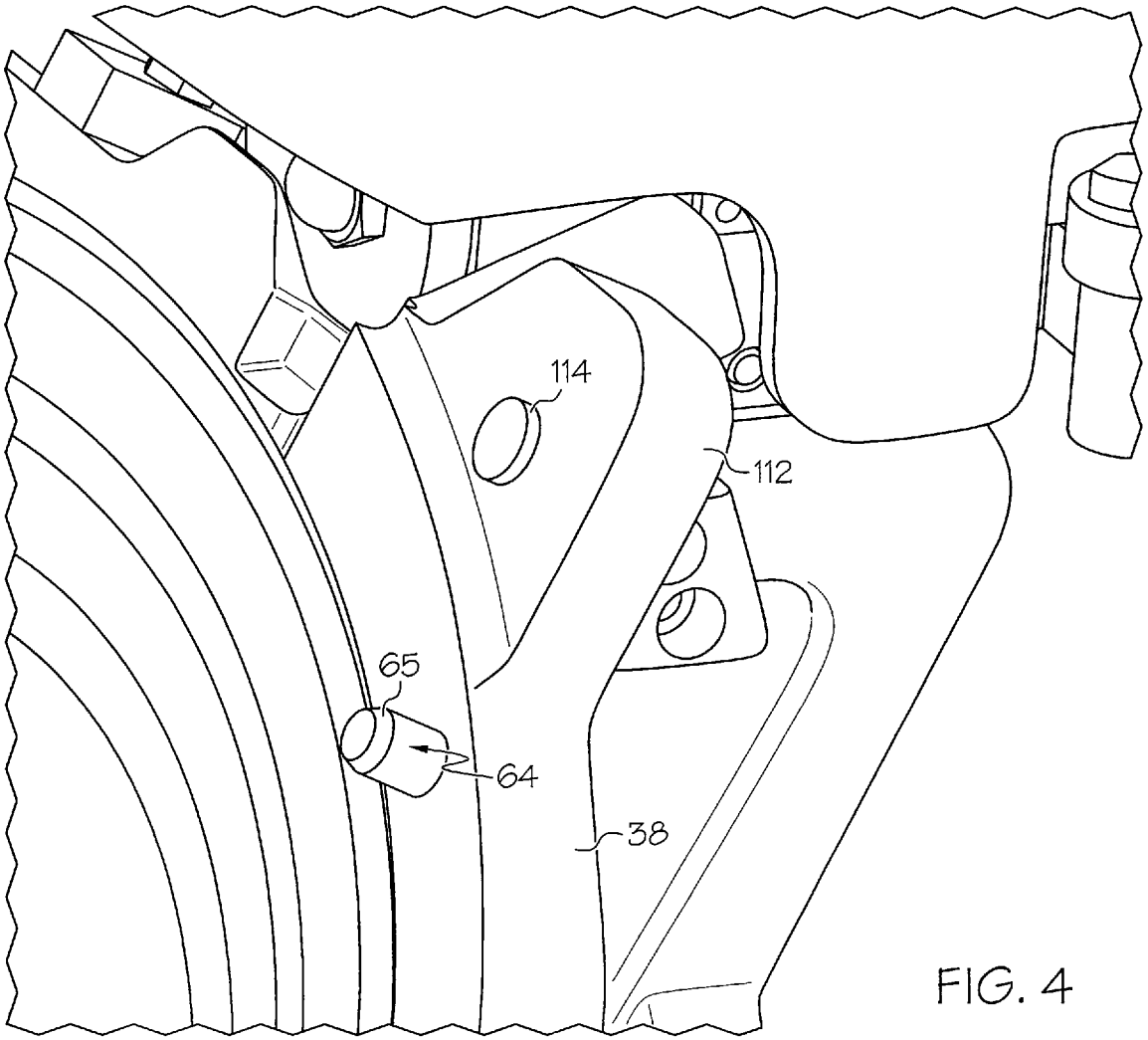
FIG. 4 is a partial perspective front view of the upper portion of a slicer and associated ring guard with magnet.
Figure 5:
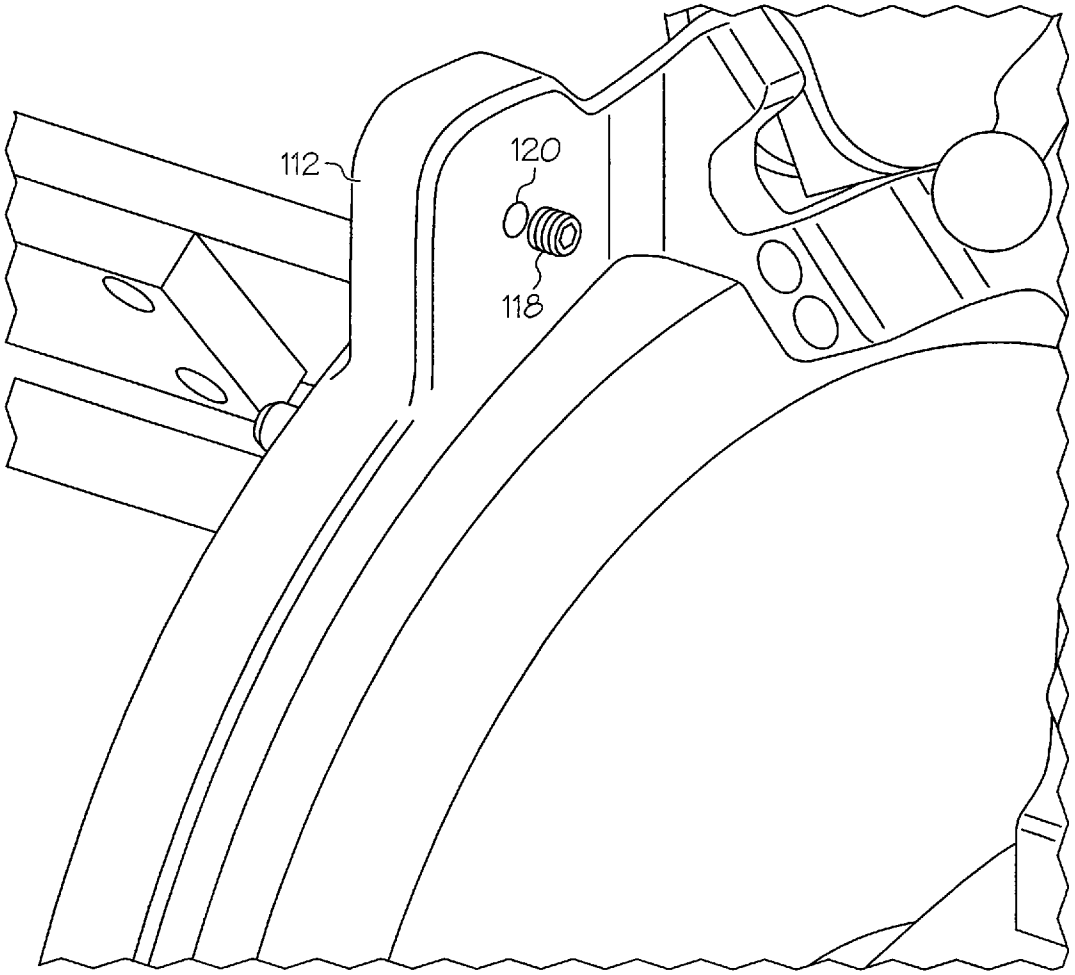
FIG. 5 is a partial perspective rear view of the upper portion of a slicer and associated ring guard with magnet.
Figure 7:
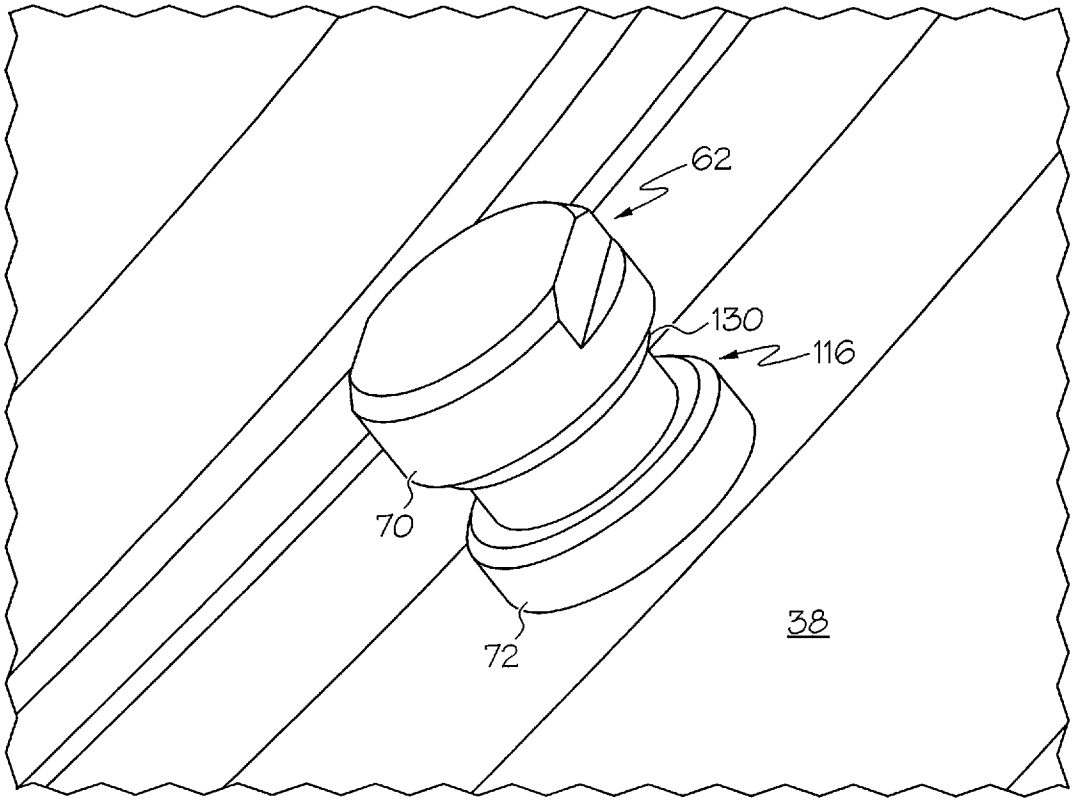
FIG. 7 is a perspective view of one embodiment of a lower pin member of the ring guard.

Referring to FIGS. 3 and 4, showing a partial view of the slicer with the cover plate removed, the ring guard 38 includes locating pins 60, 62 and 64 that are positioned for alignment with the cover plate slots 100, 102 and cover plate pin hole 104 respectively. The ring guard 38 further includes an upper extension part 112 having a magnet 114 positioned thereon. The pin 64 may include an end chamfer or round 65 to facilitate placement within the cover plate pin hole 104. As suggested in FIG. 7, the ring guard pins 60 and 62 may include enlarged head portions 70 and base portions 72 such that the peripheral portions of the cover plate defining the slots 100 and 102 seat in the space 116 between the head portion and the base portions. The head portion 70 may also include a taper 130 to facilitate installation of the cover plate.

Figure 6:
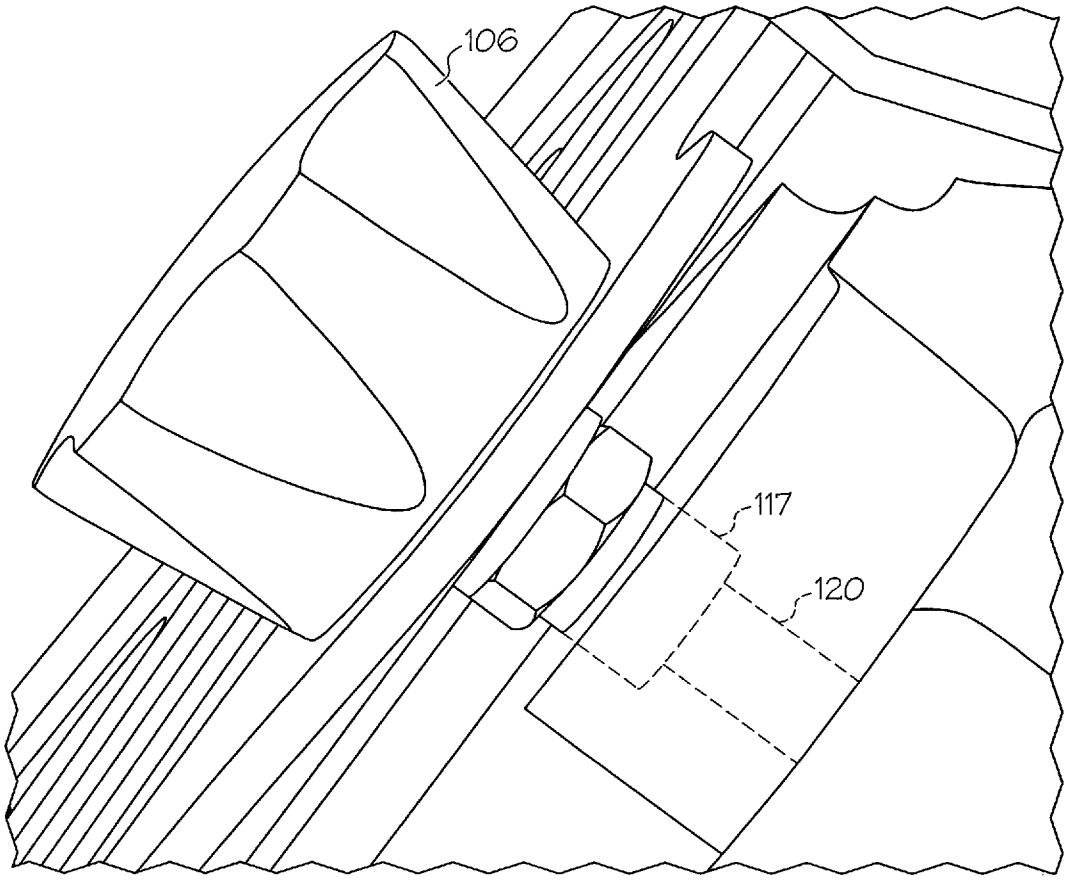
FIG. 6 is a partial side perspective view of a cover plate knob fastener in alignment with the magnet of the ring guard.

Referring to FIG. 6, the ring guard extension part 112 may include a recess 117 in its outward surface into which the magnet 114 is seated, and a set screw 118 may be provided for adjustment of the location of the magnet within the recess (e.g., how much the magnet protrudes from the ring guard), the set screw being threaded within a rear opening 120 on the extension part 112 and the rear opening 120 extending all the way to the recess that receives the magnet 114. Notably, the magnet 114 is positioned on the ring guard 38 and located radially outwardly of the peripheral edge of the slicer knife 24 to reduce interaction between the magnet and the slicer knife (in cases where the knife is of a magnetic material). Removal and replacement of the slicer knife 24 is achieved without requiring removal of the magnet 114.

Notably, the head of the screw/bolt 108 that secures the cover plate knob 106 aligns with the magnet 114 positioned on the ring guard. In the illustrated embodiment the major body portion of the knife cover plate can be formed of a non-magnetic material (such as aluminum or stainless without magnetic properties). When the cover plate 20 is positioned on the slicer, the head of the screw/bolt 108 and the magnetic field of the magnet 114 interact (see FIG. 6) to hold the cover plate in place. The holding force can be overcome manually if the handle or knob 106 of the cover plate is pulled with sufficient force. To install the cover plate 20 to the slicer, the lower portion of the cover plate 20 is first slid into position with slots 100 and 102 in the space 116 defined by the locating pins 60 and 62. When the slots 100 and 102 are properly positioned on the pins 60 and 62, the upper portion of the cover plate is moved backward such that pin hole 104 slides over the ring guard pin 64, forcing the head of screw/bolt 108 to align with and sit adjacent to the magnet 114 to hold the cover plate 20 in the position. To uninstall, the fixed knob 106 on the cover plate 20 is pulled to separate the screw from the magnet and pull pin hole 104 away from the pin 64. The cover plate can then be moved slightly upward such that the slots 100 and 102 adequately clear the pin structures 60 and 62. The subject cover plate provides for simple removal and replacement as needed (e.g., for knife access and removal), preferably without any moving parts.

Thus, a method of utilizing a knife cover plate in conjunction with a slicer having a slicer body, a circular slicer knife mounted for rotation relative to the slicer body, the slicer knife having a peripheral cutting edge and a carriage mounted for moving food product back and forth past the slicer knife is provided. A magnet is located on one of a portion of the knife cover plate or a mount portion of the slicer and a part formed of magnetic material is located on the other of the portion of the knife cover plate or the mount portion of the slicer. Mounting the knife cover plate onto the slicer involves positioning the knife cover plate such that a magnetic field of the magnet interacts with the part to pull the knife cover plate toward the mount portion of the slicer to aid in retaining the knife cover plate on the slicer. Removing the knife cover plate from the slicer by pulling the portion of the knife cover plate away from the mount portion of the slicer. The knife cover plate pivots as the portion of the knife cover plate is pulled away from the mount portion of the slicer. In the illustrated embodiment, a knob is located on or proximate to the portion of the knife cover plate and another portion of the knife cover plate includes at least one slot engaged with a pin on the slicer. During pivoting of the knife cover plate the slot remains engaged with the pin.

Upon removal, the entire knife cover plate can be washed in a sink, tub or dishwasher.

It is to be clearly understood that the above description is intended by way of illustration and example only, is not intended to be taken by way of limitation, and that other changes and modifications are possible. For example, the location of the pins and magnet could be varied. In an alternative embodiment, the magnet could be mounted on the knife cover plate instead of the slicer. More than one magnet could also be utilized.

What is claimed is:

1. A slicer for use in slicing a food product, the slicer comprising:
- a slicer body;
- a circular slicer knife mounted for rotation relative to the slicer body, the slicer knife having a peripheral cutting edge;
- a carriage mounted for moving food product back and forth past the slicer knife;
- a knife cover plate removably mounted to the slicer and covering a face portion and edge portion of the slicer knife, the knife cover plate held in place on the slicer at least in part by a magnet mounted on the slicer.

2. The slicer of claim 1 wherein the magnet is located radially outward of the peripheral cutting edge of the slicer knife.

3. The slicer of claim 2, further comprising:
- a ring guard disposed about the peripheral cutting edge along at least a portion of a non-cutting zone of the circular slice knife, the magnet mounted on a portion of the ring guard.

4. The slicer of claim 3 wherein the portion of the ring guard comprises an extension part that is located toward an upper portion of the ring guard.

5. The slicer of claim 3 wherein a position of the magnet relative to the ring guard is adjustable.

6. The slicer of claim 5 wherein the position of the magnet is adjustable along an axis the enables movement of the magnet toward or away from the knife cover plate.

7. The slicer of claim 1 wherein the knife cover plate includes a knob mounted thereon, the knob secured by a fastener having a head portion that aligns with the magnet to interact with a magnetic field of the magnet.

8. The slicer of claim 1 wherein the knife cover plate further includes at least two slots or openings mounted on at least two pins of the slicer.

9. The slicer of claim 1 wherein a portion of the knife cover plate proximate the magnet includes a graspable knob thereon, pulling the knob pulls the knife cover plate away from the slicer by pivoting the knife cover plate.

10. A slicer for use in slicing a food product, the slicer comprising:
- a slicer body;
- a circular slicer knife mounted for rotation relative to the slicer body, the slicer knife having a peripheral cutting edge;
- a carriage mounted for moving food product back and forth past the slicer knife;
- a knife cover plate removably mounted to the slicer and covering a face portion and edge portion of the slicer knife, the knife cover plate held in place on the slicer at least in part by a magnetic field that operates to pull the knife cover plate toward the slicer, but which magnetic field can be overcome for removal of the knife cover plate by manually pulling the knife cover plate away from the slicer, the knife cover plate removable from the slicer while the slicer knife remains on the slicer.

11. The slicer of claim 10 wherein the knife cover plate includes a graspable knob thereon in a vicinity of the magnetic field, pulling the knob pulls the knife cover plate away from the slicer by pivoting the knife cover plate away from the slicer knife.

12. The slicer of claim 11 wherein the knob is located on an upper portion of the knife cover plate, a lower portion of the knife cover plate includes at least one slot engaged with a pin on the slicer, and pulling the knob pulls the knife cover plate away from the slicer by pivoting the upper portion of the knife cover plate away from the slicer while the slot in the lower portion of the knife cover plate remains engaged with the pin.

13. The slicer of claim 12 wherein the lower portion of the knife cover plate includes firs and second spaced apart slots engaged with first and second pins of the slicer respectively.

14. The slicer of claim 10 wherein a strength of interaction of the magnetic field with the knife cover plate can be adjusted.

15. The slicer of claim 14 wherein the magnetic field is produced by a magnet mounted on the slicer and the strength of interaction can be adjusted by varying a position of the magnet on the slicer to adjust a distance between the magnet and the knife cover plate.

16. The slicer of claim 10 wherein the knife cover plate is formed primarily of a non-magnetic material, with a magnetic material part located thereon for interacting with the magnetic field.

17. A method of utilizing a knife cover plate in conjunction with a slicer having a slicer body, a circular slicer knife mounted for rotation relative to the slicer body, the slicer knife having a peripheral cutting edge and a carriage mounted for moving food product back and forth past the slicer knife, the method comprising:
- locating a magnet on one of a portion of the knife cover plate or a mount portion of the slicer;
- locating a part formed of magnetic material on the other of the portion of the knife cover plate or the mount portion of the slicer;

mounting the knife cover plate onto the slicer by positioning the knife cover plate such that a magnetic field of the magnet interacts with the part to pull the knife cover plate toward the mount portion of the slicer to aid in retaining the knife cover plate on the slicer.

18. The method of claim 17, further comprising:

removing the knife cover plate from the slicer by pulling the portion of the knife cover plate away from the mount portion of the slicer.

19. The method of claim 18 wherein the knife cover plate pivots away from the slicer knife as the portion of the knife cover plate is pulled away from the mount portion of the slicer.

20. The method of claim 19 wherein a knob is located on or proximate to the portion of the knife cover plate, another portion of the knife cover plate includes at least one slot engaged with a pin on the slicer, and during pivoting of the knife cover plate the slot remains engaged with the pin.

* * * * *